US011536453B2

(12) United States Patent
Ochiai

(10) Patent No.: US 11,536,453 B2
(45) Date of Patent: Dec. 27, 2022

(54) CIGARETTE LIGHTER WITH A NEW FUEL RELEASE SYSTEM

(71) Applicant: Tokai Seiki Co. (HK), Ltd., Tuen Mun OT (HK)

(72) Inventor: Yuzo Ochiai, Shizuoka (JP)

(73) Assignee: Tokai Seiki Co. (H.K.), Ltd., Tuen Mun (HK)

( * ) Notice: Subject to any disclaimer, the term of this patent is extended or adjusted under 35 U.S.C. 154(b) by 206 days.

(21) Appl. No.: 16/667,681

(22) Filed: Oct. 29, 2019

(65) Prior Publication Data

US 2021/0123599 A1 Apr. 29, 2021

(51) Int. Cl.

| | |
|---|---|
| ***F23Q 2/02*** | (2006.01) |
| ***F23Q 2/48*** | (2006.01) |
| ***F23Q 2/46*** | (2006.01) |
| ***F23Q 2/42*** | (2006.01) |

(52) U.S. Cl.

CPC ..... *F23Q 2/02* (2013.01); *F23Q 2/42* (2013.01); *F23Q 2/46* (2013.01); *F23Q 2/48* (2013.01)

(58) Field of Classification Search

CPC . F23Q 2/173; F23Q 2/16; F23Q 2/163; F16K 31/602; F16K 1/32; F16K 1/34; F16K 1/36; F16K 1/38; F16K 1/42; F16K 1/44; F16K 1/46; F16K 31/605

See application file for complete search history.

(56) References Cited

U.S. PATENT DOCUMENTS

| | | | | |
|---|---|---|---|---|
| 3,630,653 | A * | 12/1971 | Wright | F23Q 2/52 431/174 |
| 4,099,907 | A * | 7/1978 | Fuller | F23Q 2/161 431/254 |
| 5,020,990 | A * | 6/1991 | Chen | F23Q 2/167 431/274 |
| 5,388,986 | A * | 2/1995 | Khemarangsan | F23Q 2/167 431/206 |
| 6,537,062 | B1 * | 3/2003 | Wong | F23Q 2/161 431/133 |
| 2003/0003412 | A1 * | 1/2003 | Chung Yang | F23Q 2/164 431/153 |
| 2013/0273484 | A1 * | 10/2013 | Lefebvre | F16K 1/32 431/131 |

FOREIGN PATENT DOCUMENTS

| | | |
|---|---|---|
| CN | 210688306 U | 6/2020 |

* cited by examiner

*Primary Examiner* — Alfred Basichas
(74) *Attorney, Agent, or Firm* — Trojan Law Offices

(57) ABSTRACT

The present invention relates to a cigarette lighter having a fuel reservoir configured to contain a combustible fuel. The cigarette lighter includes a pre-mixing burner flame generating unit configured to mix the combustible fuel with air and contain a flame. The cigarette lighter includes a valve in fluidic communication with the fuel reservoir and the pre-mixing burner flame generating unit and configured to facilitate the combustible fuel to enter the pre-mixing burner flame generating unit when the valve is actuated. The cigarette lighter includes a bracket configured to actuate the valve when a force is applied by a user and includes a friction wheel assembly in mechanical communication with the bracket and configured to rotate about an axis. The cigarette lighter includes a flint in mechanical communication with the friction wheel assembly and configured to emit spark when the friction wheel assembly is rotated about the axis by a user.

12 Claims, 8 Drawing Sheets

CIGARETTE LIGHTER WITH A NEW FUEL RELEASE SYSTEM

BACKGROUND

1. Field

This specification relates to a cigarette lighter. More specifically, this specification relates to a cigarette lighter with a new fuel release system.

2. Description of the Related Art

Cigarette lighters that are equipped with a pre-mixing burner flame generating unit, such as jet flame or turbo flame lighters, offer numerous advantages over other forms of lighters. The biggest advantages include a more windproof flame as well as a more complete combustion of the combustible fuel. However, most cigarette lighters that are equipped with a pre-mixing burner flame generating unit use a piezoelectric ignition to ignite the combustible fuel (i.e. butane). While piezoelectric ignitions are generally reliable they do not offer the simplicity of manufacturing and increased reliability that traditional flint ignitions are able to inherently offer.

What is needed is a cigarette lighter that combines the enhanced burning characteristics of the pre-mixing burner flame generating unit with the simplicity and reliability of traditional flint ignitions. However, traditional flint ignitions are not used with pre-mixing burner flame generating units because of inherent functional reliability issues. The main culprit behind these functional reliability issues lie in the improper timing between the release of the combustible fuel and the sparks emitted by traditional flint ignitions. More specifically, the sparks emitted by traditional flint ignitions are generated too early to reliably ignite the gas. For example, when a user actuates the friction wheel assembly with their thumb, sparks are generated before their thumb has a chance to actuate the gas lever. This results in unreliable combustion of the combustible fuel and frustration for the user.

Previous cigarette lighters that attempted to address the above issues, for example the Wind Master and Wind Master 2 cigarette lighters by Windmill, resulted in increased complexity of both the design and function of the cigarette lighter as well as the associated manufacturing. Additional cigarette lighters, for example the AM7101 and AM369 by Wenzhou Zhibo Light Industrial Products Co., LTD, resulted in cigarette lighters that pose increased safety risks to the user to the user.

Therefore, there exists a need for a cigarette lighter that combines a pre-mixing burner flame generating unit with a traditional flint ignition without the above-mentioned drawbacks.

SUMMARY

In general, one aspect of the subject matter described in this specification is embodied in a cigarette lighter. The cigarette lighter includes a fuel reservoir configured to contain a combustible fuel. The cigarette lighter includes a pre-mixing burner flame generating unit configured to mix the combustible fuel with air and contain a flame. The cigarette lighter includes a valve in fluidic communication with the fuel reservoir and the pre-mixing burner flame generating unit that is configured to facilitate the combustible fuel to enter the pre-mixing burner flame generating unit when the valve is actuated. The cigarette lighter includes a bracket configured to actuate the valve when a force is applied by a user. The cigarette lighter includes a friction wheel assembly in mechanical communication with the bracket and configured to rotate about an axis. The cigarette lighter includes a flint in mechanical communication with the friction wheel assembly and configured to emit sparks when the friction wheel assembly is rotated about the axis by a user.

These and other embodiments may include one or more of the following features. The cigarette lighter may include a gas lever in mechanical communication with the valve and the bracket, the gas lever may be configured to facilitate the actuation of the valve when a force is applied to the bracket by a user. The gas lever may rotate about a gas lever fulcrum.

The cigarette lighter may include a spring, wherein the flint may be located between the friction wheel assembly and the spring. The spring may be configured to apply a spring force on the flint to force the flint against the friction wheel assembly. The spring force may lie along an axis that is perpendicular to the axis of rotation of the friction wheel assembly. The spring and the flint may be located within the bracket. The friction wheel assembly may be coupled to the bracket. The bracket may be configured to actuate along an axis parallel to the axis of the spring force.

The cigarette lighter may include a thumb ledge coupled to the bracket and configured to allow a user to exert a force on the bracket. The bracket and the thumb ledge may form a single integral component.

Another aspect of the subject matter described in this specification is embodied in a cigarette lighter. The cigarette lighter includes a body extending along an axis and having a first end and a second end opposite the first end. The cigarette lighter includes a fuel reservoir located within the body and configured to contain a combustible fuel. The cigarette lighter includes a pre-mixing burner flame generating unit located adjacent to the first end of the body and configured to mix the combustible fuel with air and contain a flame. The cigarette lighter includes a valve in fluidic communication with the fuel reservoir and the pre-mixing burner flame generating unit and configured to facilitate the combustible fuel to enter the pre-mixing burner flame generating unit when the valve is actuated. The cigarette lighter includes a gas discharge and ignition operating unit located adjacent to the first end of the body and adjacent to the pre-mixing burner flame generating unit, the gas discharge and ignition operating unit being configured to actuate the valve and emit sparks when one or more forces are applied the gas discharge and ignition operating unit by a user.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

In the following detailed description, numerous specific details are set forth to provide an understanding of the present disclosure. It will be apparent however, to one of ordinary skill in the art that elements of the present disclosure may be practiced without some of these specific details. In other instances, well-known structures and techniques have not been shown in detail to avoid unnecessarily obscuring the present disclosure.

Figure 1:
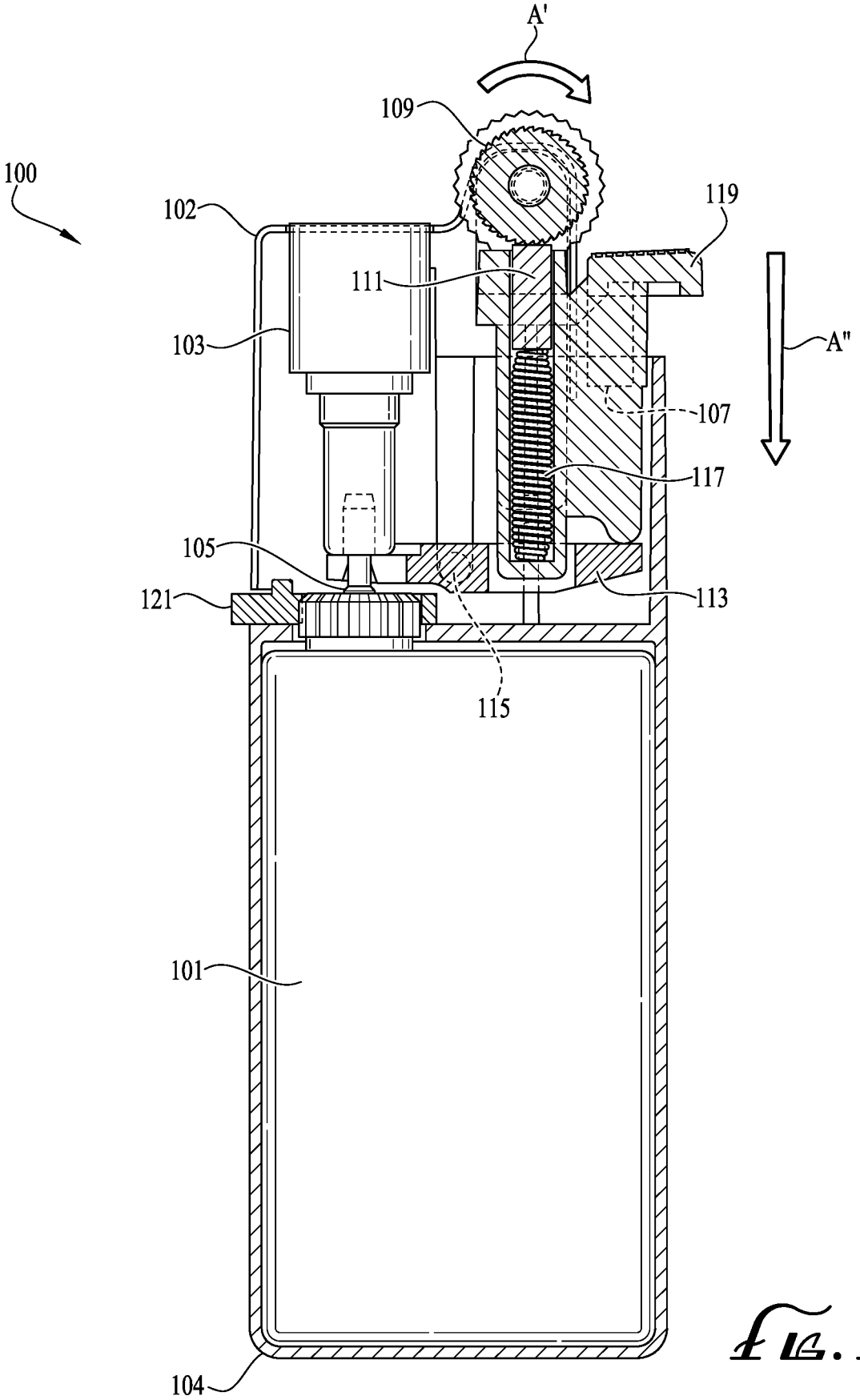
FIG. 1 shows a cross sectional view of a cigarette lighter according to an aspect of the invention.

FIG. 1 illustrates a cross sectional view of a cigarette lighter 100 according to an embodiment of the invention. The cigarette lighter 100 includes a body extending along an axis and having a first end 102 and a second end 104 opposite the first end 102. The cigarette lighter 100 is depicted as rectangular in shape. However, other shapes may be used interchangeably according to various embodiments. For example, the cigarette lighter 100 may be square, cylindrical, hexagonal, or spherical in shape. The body of the cigarette lighter 100 may be formed from plastic, metal, or a combination of plastic and metal.

The cigarette lighter 100 includes a fuel reservoir 101 located within the body. In other embodiments, the fuel reservoir 101 may form part of the body of the cigarette lighter 100. For example, the fuel reservoir 101 may be in the form of a casing that allows a user to grip the surface. In some embodiments, the fuel reservoir 101 may be detachable from the other components of the cigarette lighter 100. The fuel reservoir 101 may be configured to contain a combustible fuel. For example, the fuel reservoir 101 may be configured to contain butane.

The cigarette lighter 100 includes a pre-mixing burner flame generating unit 103. The pre-mixing burner flame generating unit 103 may be located adjacent to the first end 102 of the body. In other embodiments, the pre-mixing burner flame generating unit 103 may be located elsewhere on the body of the cigarette lighter 100. For example, the pre-mixing burner flame generating unit 103 may be located between the first end 102 and the second end 104 of the body. The pre-mixing burner flame generating unit 103 may be configured to mix the combustible fuel with air and at least partially contain a flame.

The cigarette lighter 100 includes a valve 105 in fluidic communication with the fuel reservoir 101 and the pre-mixing burner flame generating unit 103. The valve 105 may be configured to facilitate the combustible fuel to enter the pre-mixing burner flame generating unit 103 when the valve 105 is actuated. The valve 105 may be in mechanical communication with an adjustor 121. The adjustor 121 may allow a user to adjust the amount of combustible fuel released into the pre-mixing burner flame generating unit 103 when the valve 105 is actuated. The adjustor 121 may be configured to allow continuous adjustment through a range of settings similar to the function of a volume knob on a stereo. In other embodiments, the adjustor 121 may be configured to allow only incremental adjustments. For example, the adjustor 121 may be configured to allow a user to select a low, medium, and high setting. However, other forms of adjusting may be used interchangeably according to various embodiments.

The cigarette lighter 100 may include a bracket 107. The bracket 107 may be in mechanical communication with the valve 105 and configured to actuate the valve 105 when a force is applied to the bracket 107 by a user. The cigarette lighter 100 may further include a gas lever 113 in mechanical communication with the valve 105 and the bracket 107. The gas lever 113 may be configured to facilitate actuation of the valve 105 when a force is applied to the bracket 107 by a user. In some embodiments, the gas lever 113 may rotate about a gas lever fulcrum 115. For example, when the bracket 107 is pushed down along the A" axis, the portion of the gas lever 113 immediately adjacent to the bracket 107 is also pushed down. The gas lever 113 rotates about the gas lever fulcrum 115 such that the portion of the gas lever 113 immediately adjacent to the valve 105 pushes up on the valve 105. When the valve 105 is pushed up, the valve 105 is actuated which releases the combustible fuel into the pre-mixing burner flame generating unit 103.

In some embodiments, the bracket 107 and the gas lever 113 may be mechanically coupled together. For example, the bracket 107 and the gas lever 113 may be pinned, screwed, or glued together. In other embodiments, the bracket 107 and the gas lever 113 may be a single integrated component. Still in other embodiments, the bracket 107 and the gas lever 113 may be separate components in mechanical communication with each other.

The cigarette lighter 100 may include a thumb ledge 119 mechanically coupled to the bracket 107. For example, the bracket 107 and the thumb ledge 119 may be pinned, screwed, or glued together. In other embodiments, the bracket 107 and the thumb ledge 119 may be a single integrated component. The thumb ledge 119 may be configured to allow a user to exert a force on the bracket 107.

The cigarette lighter 100 may include a friction wheel assembly 109. The friction wheel assembly 109 may be in mechanical communication with the bracket 107 and may be configured to rotate about an axis. For example, the friction wheel assembly 109 may rotate about an axis A'.

The cigarette lighter 100 may include a flint 111. The flint 111 may be in mechanical communication with the friction wheel assembly 109 and may be configured to emit sparks when the friction wheel assembly 109 is rotated about the axis by a user. For example, the flint 111 may emit sparks when the friction wheel assembly 109 is rotated about the axis A' by a user.

The cigarette lighter 100 may include a spring 117. The spring 117 may be placed adjacent to the flint 111 such that the flint 111 is located between the friction wheel assembly 109 and the spring 117. The spring 117 may be configured to apply a spring force on the flint 111 to force the flint 111 against the friction wheel assembly 109. This may allow for a more reliable generation of sparks due to the flint 111 being forced against the friction wheel assembly 109. In some embodiments, the spring force may lie along an axis that is perpendicular to the axis of rotation of the friction wheel assembly 109. For example, the spring force may lie along an axis that is perpendicular to axis A'. In some embodiments, the bracket 107 may be configured to actuate along an axis parallel to the axis of the spring force. For example, the bracket 107 may be configured to actuate along axis A".

In some embodiments, the spring 117 and the flint 111 may be located within the bracket 107. For example, the bracket 107 may have a cavity where the flint 111 and the spring 117 are located. In some embodiments, the friction wheel assembly 109 may be coupled to the bracket 107. In other embodiments, the friction wheel assembly 109 may be coupled to the body of the cigarette lighter 100 via a flexible coupler. For example, the friction wheel assembly 109 may be coupled to the first end 102 of the body and positioned such that the flint 111 and the spring 117 are prevented from leaving the cavity of the bracket 107.

Figure 2:
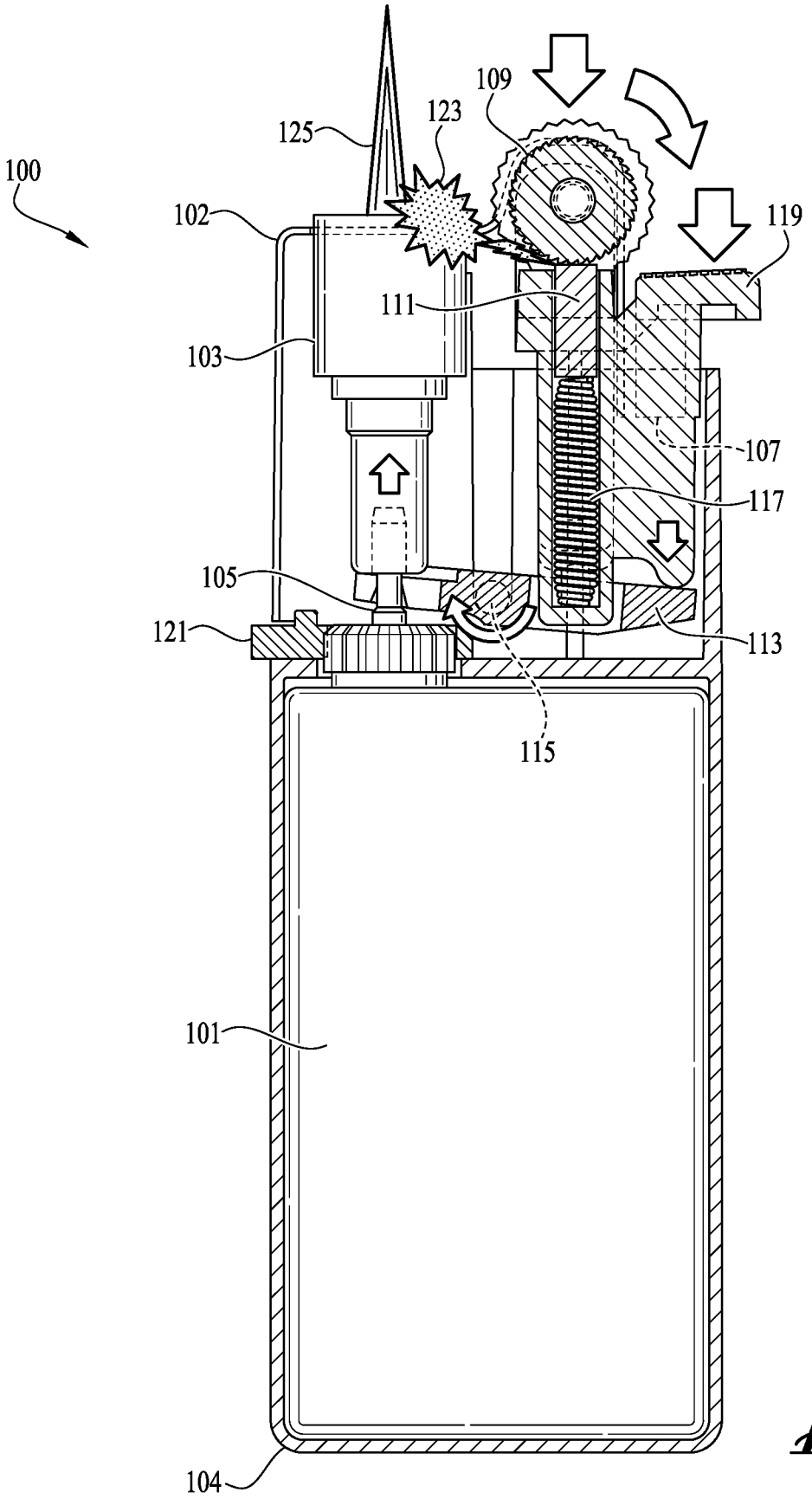
FIG. 2 shows a cross sectional view of the cigarette lighter from FIG. 1 according to an aspect of the invention.

FIG. 2 illustrates a cross sectional view of the cigarette lighter 100 from FIG. 1 according to an embodiment of the invention. More specifically, FIG. 2 illustrates the actuation of the cigarette lighter 100 by a user.

To actuate the cigarette lighter 100, a user may first initiate a gas discharge operation. According to various embodiments, the gas discharge operation is as follows. A user may first apply a downward force on the friction wheel assembly 109. The downward force causes the friction wheel assembly 109 and the bracket 107 to move down under the downward force from the user. As the bracket 107 moves down it causes the gas lever 113 to rotate about the gas lever fulcrum 115. As the gas lever 113 rotates a portion of the gas lever 113 actuates the valve 105. When the valve 105 is actuated, the combustible fuel is released from the fuel reservoir 101 and enters the pre-mixing burner flame generating unit 103.

Next a user may then initiate an ignition operation. According to various embodiments, the ignition operation is as follows. While the user is applying a downward force on the friction wheel assembly 109, the user may apply a rotational force to the friction wheel assembly 109. When the friction wheel assembly 109 receives the rotational force by the user, the friction wheel assembly 109 rotates against a surface of the flint 111 to cause the flint 111 to emit sparks 123. When the sparks 123 contact the combustible fuel in the pre-mixing burner flame generating unit 103 a flame 125 is produced. The pre-mixing burner flame generating unit 103 will continue to hold the flame 125 for as long as the combustible fuel is being supplied to it. For example, the pre-mixing burner flame generating unit 103 will continue to hold the flame 125 as long as the user keeps applying a downward force to the friction wheel assembly 109 or the bracket 107.

In some embodiments, the gas discharge operation and the friction operation may be performed simultaneously by a user. For example, a user may simultaneously apply a downward force on the friction wheel assembly 109 while also applying a rotational force to the friction wheel assembly 109. Under this scenario, the user causes sparks 123 to be generated at the same time the combustible fuel is being supplied to the pre-mixing burner flame generating unit 103 which produces the flame 125.

In other embodiments, a user may simultaneously apply a downward force on the friction wheel assembly 109 while also applying a rotational force to the friction wheel assembly 109 before the user shifts to a downward force to the bracket 107. Under this scenario, the user causes sparks 123 to be generated at the same time the combustible fuel is being supplied to the pre-mixing burner flame generating unit 103. After the flame 125 is generated the user shifts the downward force to bracket 107 to continue supplying the combustible fuel to the pre-mixing burner flame generating unit 103 which ensures an uninterrupted flame 125.

Figure 3:
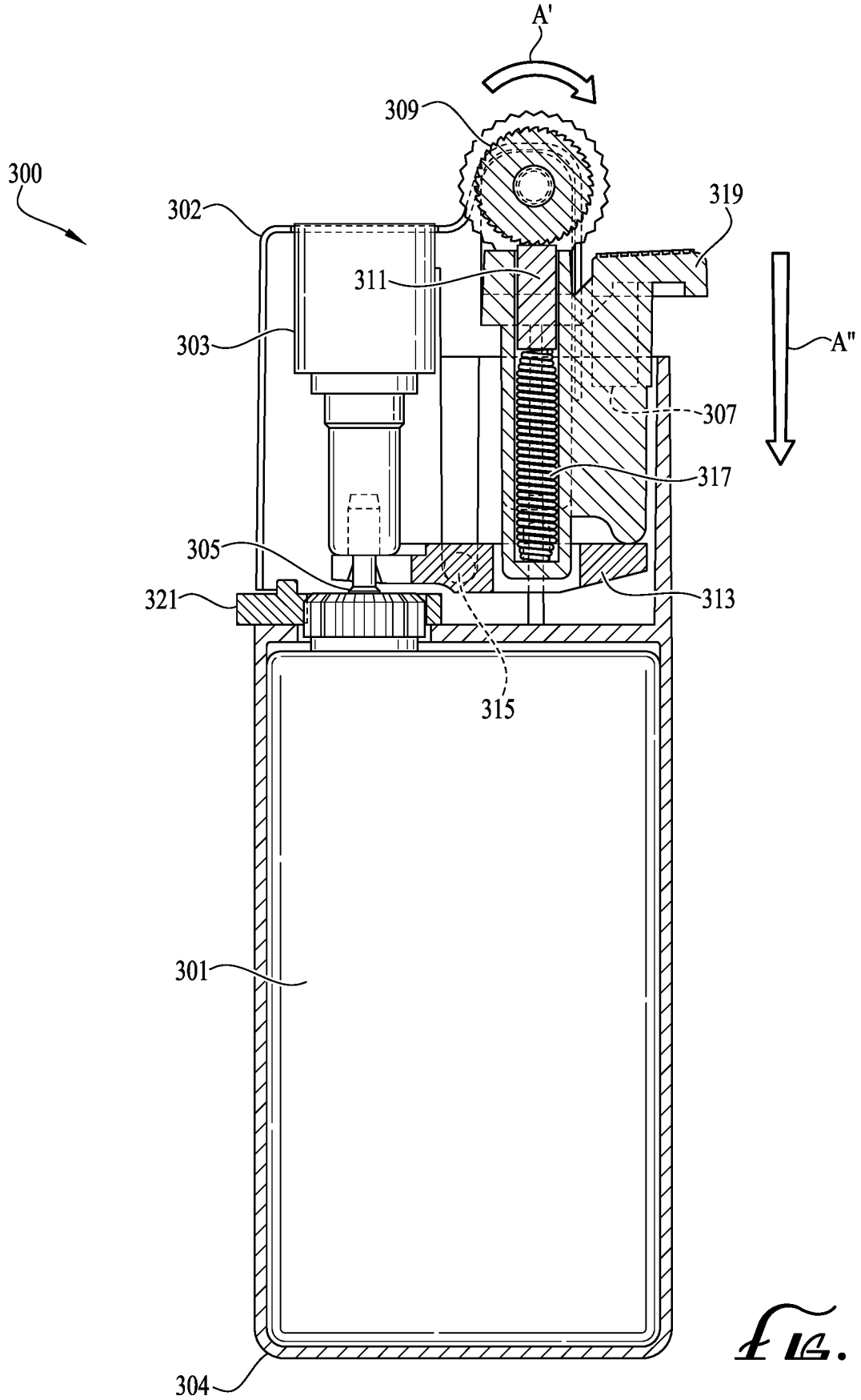
FIG. 3 shows a cross sectional view of a cigarette lighter according to an aspect of the invention.

FIG. 3 illustrates a cross sectional view of a cigarette lighter 300 according to an embodiment of the invention. The cigarette lighter 300 includes a body extending along an axis and having a first end 302 and a second end 304 opposite the first end 302. The cigarette lighter 300 is depicted as rectangular in shape. However, other shapes may be used interchangeably according to various embodiments. For example, the cigarette lighter 300 may be square, cylindrical, hexagonal, or spherical in shape. The body of the cigarette lighter 300 may be formed from plastic, metal, or a combination of plastic and metal.

The cigarette lighter 300 includes a fuel reservoir 301 located within the body. In other embodiments, the fuel reservoir 301 may form part of the body of the cigarette lighter 300. For example, the fuel reservoir 301 may be in the form of a casing that allows a user to grip the surface. In some embodiments, the fuel reservoir 301 may be detachable from the other components of the cigarette lighter 300. The fuel reservoir 301 may be configured to contain a combustible fuel. For example, the fuel reservoir 301 may be configured to contain butane.

The cigarette lighter 300 includes a pre-mixing burner flame generating unit 303. The pre-mixing burner flame generating unit 303 may be located adjacent to the first end 302 of the body. In other embodiments, the pre-mixing burner flame generating unit 303 may be located elsewhere on the body of the cigarette lighter 300. For example, the pre-mixing burner flame generating unit 303 may be located between the first end 302 and the second end 304 of the body. The pre-mixing burner flame generating unit 303 may be configured to mix the combustible fuel with air and at least partially contain a flame.

The cigarette lighter 300 includes a valve 305 in fluidic communication with the fuel reservoir 301 and the pre-mixing burner flame generating unit 303. The valve 305 may be configured to facilitate the combustible fuel to enter the pre-mixing burner flame generating unit 303 when the valve 305 is actuated. The valve 305 may be in mechanical communication with an adjustor 321. The adjustor 321 may allow a user to adjust the amount of combustible fuel released into the pre-mixing burner flame generating unit 303 when the valve 305 is actuated. The adjustor 321 may be configured to allow continuous adjustment through a range of settings similar to the function of a volume knob on a stereo. In other embodiments, the adjustor 321 may be configured to allow only incremental adjustments. For example, the adjustor 321 may be configured to allow a user to select a low, medium, and high setting. However, other forms of adjusting may be used interchangeably according to various embodiments.

The cigarette lighter 300 includes a gas discharge and ignition operating unit 327. The gas discharge and ignition operating unit 327 may be located adjacent to the first end 302 of the body and adjacent to the pre-mixing burner flame generating unit 303. The gas discharge and ignition operating unit 327 may be configured to actuate the valve 305 and emit sparks when one or more forces are applied to the gas discharge and ignition operating unit 327 by a user.

In some embodiments, the gas discharge and ignition operating unit 327 may include a gas lever 313, a bracket 307, a friction wheel assembly 309, and a flint 302. The gas lever 313 may be in mechanical communication with the valve 305 and configured to rotate about a gas lever fulcrum 315. The gas lever 313 may be configured to facilitate actuation of the valve 305 when the gas lever 313 is actuated. The bracket 307 may be in mechanical communication with the gas lever 313. The bracket 307 may be configured to actuate the gas lever 313 when a force parallel to the axis of the body is applied to the bracket 307 by a user. For example, the bracket 307 may actuate the gas lever 313 when a force parallel to axis A" is applied to the bracket 307 by a user. The friction wheel assembly 309 may be in mechanical communication with the bracket 307 and may be configured to rotate about an axis. For example, the friction wheel assembly 309 may be configured to rotate about an axis A'. The flint 302 may be in mechanical communication with the friction wheel assembly 309. The flint 302 may be configured to emit sparks when the friction wheel assembly 309 is rotated about the axis by a user.

In some embodiments, the one or more forces may include a force on the bracket 307 parallel to the axis of the body and a rotational force to the friction wheel assembly 309. In other embodiments, the one or more forces may include a force on the bracket 307 perpendicular to the axis of the body and a rotational force to the friction wheel assembly 309.

In some embodiments, the bracket 307 and the gas lever 313 may be mechanically coupled together. For example, the bracket 307 and the gas lever 313 may be pinned, screwed, or glued together. In other embodiments, the bracket 307 and the gas lever 313 may be a single integrated component. Still in other embodiments, the bracket 307 and the gas lever 313 may be separate components in mechanical communication with each other. The cigarette lighter 300 may include a thumb ledge 319 mechanically coupled to the bracket 307. For example, the bracket 307 and the thumb ledge 319 may be pinned, screwed, or glued together. In other embodiments, the bracket 307 and the thumb ledge 319 may be a single integrated component. The thumb ledge 319 may be configured to allow a user to exert a force on the bracket 307.

The cigarette lighter 300 may include a spring 317. The spring 317 may be placed adjacent to the flint 311 such that the flint 311 is located between the friction wheel assembly 309 and the spring 317. The spring 317 may be configured to apply a spring force on the flint 311 to force the flint 311 against the friction wheel assembly 309. This may allow for a more reliable generation of sparks due to the flint 311 being forced against the friction wheel assembly 309. In some embodiments, the spring force may lie along an axis that is perpendicular to the axis of rotation of the friction wheel assembly 309. For example, the spring force may lie along an axis that is perpendicular to axis A'. In some embodiments, the bracket 307 may be configured to actuate along an axis parallel to the axis of the spring force. For example, the bracket 307 may be configured to actuate along axis A".

In some embodiments, the spring 317 and the flint 311 may be located within the bracket 307. For example, the bracket 307 may have a cavity where the flint 311 and the spring 317 are located. In some embodiments, the friction wheel assembly 309 may be coupled to the bracket 307. In other embodiments, the friction wheel assembly 309 may be coupled to the body of the cigarette lighter 300 via a flexible coupler. For example, the friction wheel assembly 309 may be coupled to the first end 302 of the body and positioned such that the flint 311 and the spring 317 are prevented from leaving the cavity of the bracket 307.

Figure 4A:
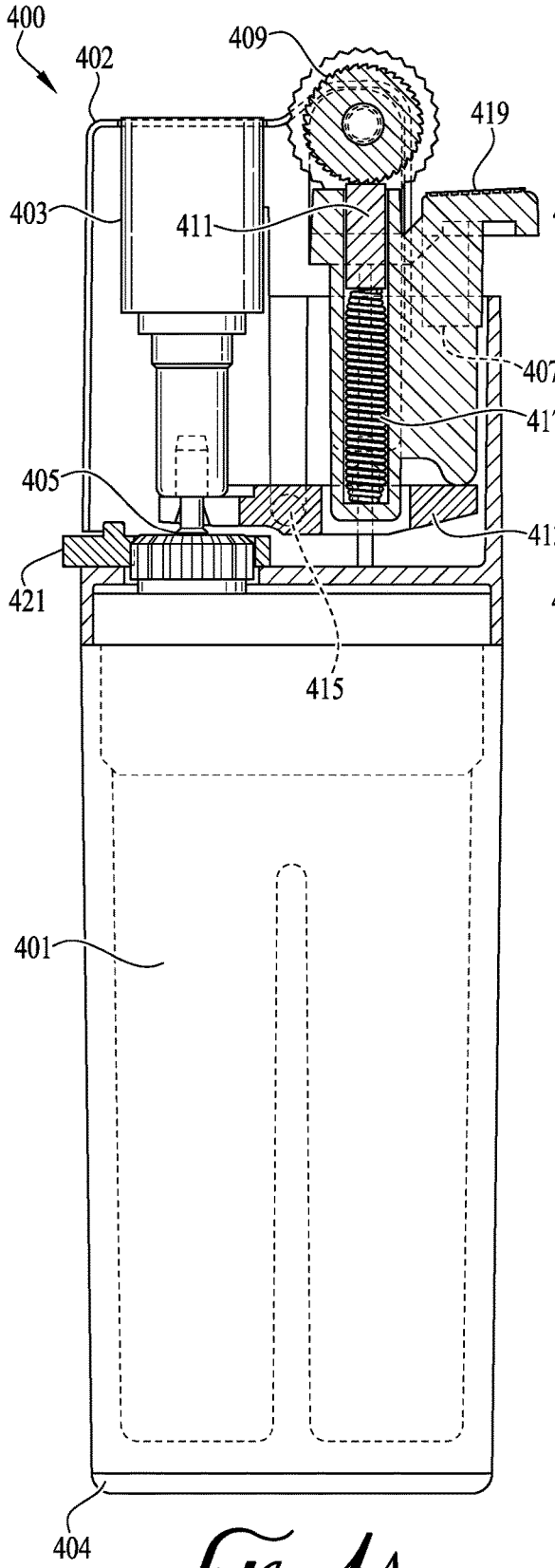
FIG. 4A shows a cross sectional view of a cigarette lighter according to an aspect of the invention.

FIG. 4A illustrates a cross sectional view of a cigarette lighter 400 according to an embodiment of the invention. The cigarette lighter 400 includes a body extending along an axis and having a first end 402 and a second end 404 opposite the first end 402. The cigarette lighter 400 is depicted as rectangular in shape. However, other shapes may be used interchangeably according to various embodiments. For example, the cigarette lighter 400 may be square, cylindrical, hexagonal, or spherical in shape. The body of the cigarette lighter 400 may be formed from plastic, metal, or a combination of plastic and metal.

The cigarette lighter 400 includes a separate fuel reservoir 401 that forms at least part of the body. The fuel reservoir 401 may be configured to contain a combustible fuel. For example, the fuel reservoir 401 may be configured to contain butane.

The cigarette lighter 400 includes a pre-mixing burner flame generating unit 403. The pre-mixing burner flame generating unit 403 may be located adjacent to the first end 402 of the body. In other embodiments, the pre-mixing burner flame generating unit 403 may be located elsewhere on the body of the cigarette lighter 400. For example, the pre-mixing burner flame generating unit 403 may be located between the first end 402 and the second end 404 of the body. The pre-mixing burner flame generating unit 403 may be configured to mix the combustible fuel with air and at least partially contain a flame.

The cigarette lighter 400 includes a valve 405 in fluidic communication with the fuel reservoir 401 and the pre-mixing burner flame generating unit 403. The valve 405 may be configured to facilitate the combustible fuel to enter the pre-mixing burner flame generating unit 403 when the valve 405 is actuated. The valve 405 may be in mechanical communication with an adjustor 421. The adjustor 421 may allow a user to adjust the amount of combustible fuel released into the pre-mixing burner flame generating unit 403 when the valve 405 is actuated. The adjustor 421 may be configured to allow continuous adjustment through a range of settings similar to the function of a volume knob on a stereo. In other embodiments, the adjustor 421 may be configured to allow only incremental adjustments. For example, the adjustor 421 may be configured to allow a user to select a low, medium, and high setting. However, other forms of adjusting may be used interchangeably according to various embodiments.

The cigarette lighter 400 may include a bracket 407. The bracket 407 may be in mechanical communication with the valve 405 and configured to actuate the valve 405 when a force is applied to the bracket 407 by a user. The cigarette lighter 400 may further include a gas lever 413 in mechanical communication with the valve 405 and the bracket 407. The gas lever 413 may be configured to facilitate actuation of the valve 405 when a force is applied to the bracket 407 by a user. In some embodiments, the gas lever 413 may rotate about a gas lever fulcrum 415. For example, when the bracket 407 is pushed down, the portion of the gas lever 413 immediately adjacent to the bracket 407 is also pushed down. The gas lever 413 rotates about the gas lever fulcrum 415 such that the portion of the gas lever 413 immediately adjacent to the valve 405 pushes up on the valve 405. When the valve 405 is pushed up, the valve 405 is actuated which releases the combustible fuel into the pre-mixing burner flame generating unit 403.

In some embodiments, the bracket 407 and the gas lever 413 may be mechanically coupled together. For example, the bracket 407 and the gas lever 413 may be pinned, screwed, or glued together. In other embodiments, the bracket 407 and the gas lever 413 may be a single integrated component. Still in other embodiments, the bracket 407 and the gas lever 413 may be separate components in mechanical communication with each other.

The cigarette lighter 400 may include a thumb ledge 419 mechanically coupled to the bracket 407. For example, the bracket 407 and the thumb ledge 419 may be pinned, screwed, or glued together. In other embodiments, the bracket 407 and the thumb ledge 419 may be a single integrated component. The thumb ledge 419 may be configured to allow a user to exert a force on the bracket 407.

The cigarette lighter 400 may include a friction wheel assembly 409. The friction wheel assembly 409 may be in mechanical communication with the bracket 407 and may be configured to rotate about an axis. The cigarette lighter 400 may include a flint 411. The flint 411 may be in mechanical communication with the friction wheel assembly 409 and may be configured to emit sparks when the friction wheel assembly 409 is rotated about the axis by a user.

The cigarette lighter 400 may include a spring 417. The spring 417 may be placed adjacent to the flint 411 such that the flint 411 is located between the friction wheel assembly 409 and the spring 417. The spring 417 may be configured to apply a spring force on the flint 411 to force the flint 411 against the friction wheel assembly 409. This may allow for a more reliable generation of sparks due to the flint 411 being forced against the friction wheel assembly 409. In some embodiments, the spring force may lie along an axis that is perpendicular to the axis of rotation of the friction wheel assembly 409. In some embodiments, the bracket 407 may be configured to actuate along an axis parallel to the axis of the spring force.

In some embodiments, the spring 417 and the flint 411 may be located within the bracket 407. For example, the bracket 407 may have a cavity where the flint 411 and the spring 417 are located. In some embodiments, the friction wheel assembly 409 may be coupled to the bracket 407. In other embodiments, the friction wheel assembly 409 may be coupled to the body of the cigarette lighter 400 via a flexible coupler. For example, the friction wheel assembly 409 may be coupled to the first end 402 of the body and positioned such that the flint 411 and the spring 417 are prevented from leaving the cavity of the bracket 407.

Figure 4B:
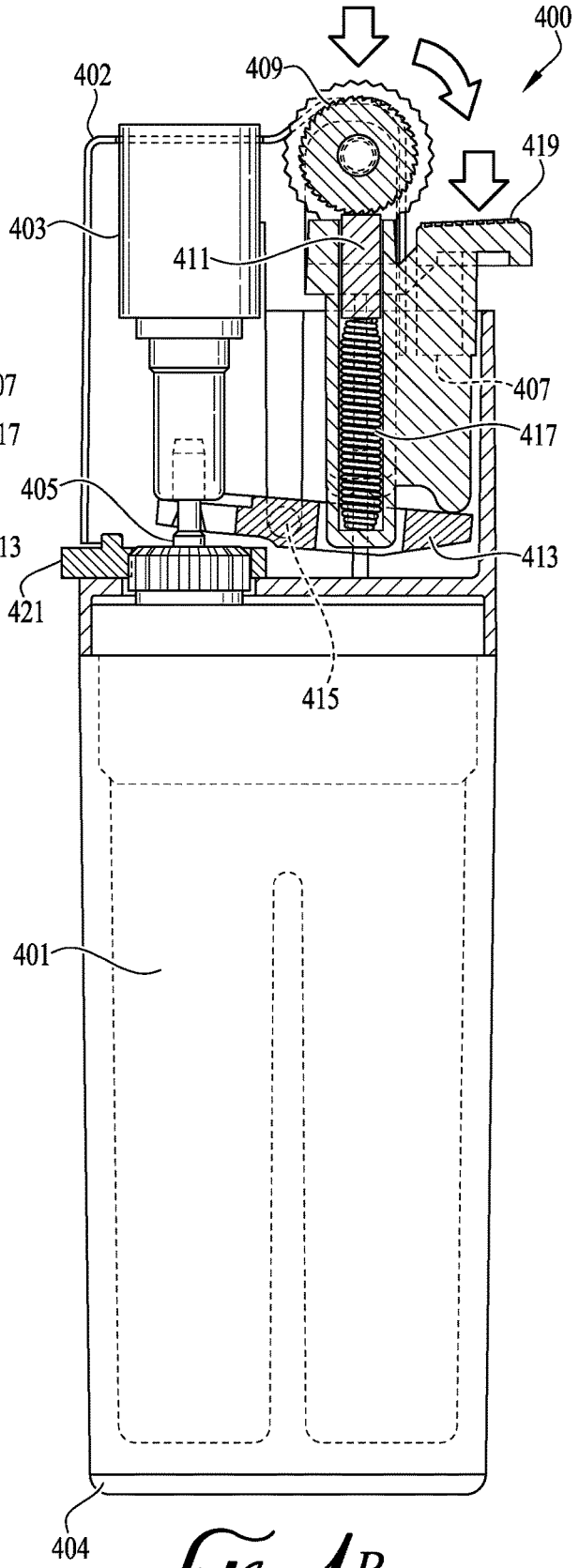
FIG. 4B shows a cross sectional view of the cigarette lighter from FIG. 4A according to an aspect of the invention.

FIG. 4B illustrates a cross sectional view of the cigarette lighter 400 from FIG. 4A according to an embodiment of the invention. More specifically, FIG. 4B illustrates the actuation of the cigarette lighter 400 by a user.

To actuate the cigarette lighter 400, a user may first initiate a gas discharge operation. According to various embodiments, the gas discharge operation is as follows. A user may first apply a downward force on the friction wheel assembly 409. The downward force causes the friction wheel assembly 409 and the bracket 407 to move down under the downward force from the user. As the bracket 407 moves down it causes the gas lever 413 to rotate about the gas lever fulcrum 415. As the gas lever 413 rotates a portion of the gas lever 413 actuates the valve 405. When the valve 405 is actuated, the combustible fuel is released from the fuel reservoir 401 and enters the pre-mixing burner flame generating unit 403.

Next a user may then initiate an ignition operation. According to various embodiments, the ignition operation is as follows. While the user is applying a downward force on the friction wheel assembly 409, the user may apply a rotational force to the friction wheel assembly 409. When the friction wheel assembly 409 receives the rotational force by the user, the friction wheel assembly 409 rotates against a surface of the flint 411 to cause the flint 411 to emit sparks. When the sparks contact the combustible fuel in the pre-mixing burner flame generating unit 403 a flame is produced. The pre-mixing burner flame generating unit 403 will continue to hold the flame for as long as the combustible fuel is being supplied to it. For example, the pre-mixing burner flame generating unit 403 will continue to hold the flame as long as the user keeps applying a downward force to the friction wheel assembly 409 or the bracket 407.

In some embodiments, the gas discharge operation and the friction operation may be performed simultaneously by a user. For example, a user may simultaneously apply a downward force on the friction wheel assembly 409 while also applying a rotational force to the friction wheel assembly 409. Under this scenario, the user causes sparks to be generated at the same time the combustible fuel is being supplied to the pre-mixing burner flame generating unit 403 which produces the flame.

In other embodiments, a user may simultaneously apply a downward force on the friction wheel assembly 409 while also applying a rotational force to the friction wheel assembly 409 before the user shifts to a downward force to the bracket 407. Under this scenario, the user causes sparks to be generated at the same time the combustible fuel is being supplied to the pre-mixing burner flame generating unit 403. After the flame is generated the user shifts the downward force to bracket 407 to continue supplying the combustible fuel to the pre-mixing burner flame generating unit 403 which ensures an uninterrupted flame.

Figure 5A:
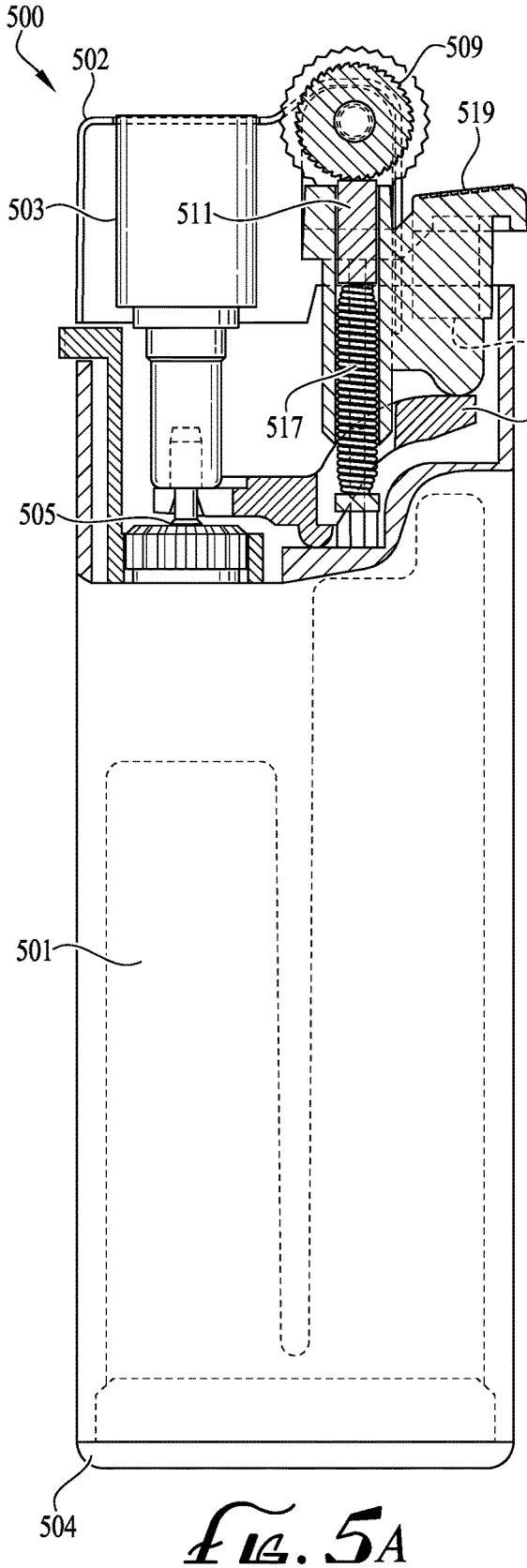
FIG. 5A shows a cross sectional view of a cigarette lighter according to an aspect of the invention.

FIG. 5A illustrates a cross sectional view of a cigarette lighter 500 according to an embodiment of the invention. The cigarette lighter 500 includes a body extending along an axis and having a first end 502 and a second end 504 opposite the first end 502. The cigarette lighter 500 is depicted as rectangular in shape. However, other shapes may be used interchangeably according to various embodiments. For example, the cigarette lighter 500 may be square, cylindrical, hexagonal, or spherical in shape. The body of the cigarette lighter 500 may be formed from plastic, metal, or a combination of plastic and metal.

The cigarette lighter 500 includes an integral fuel reservoir 501 within the body. The fuel reservoir 501 may be configured to contain a combustible fuel. For example, the fuel reservoir 501 may be configured to contain butane.

The cigarette lighter 500 includes a pre-mixing burner flame generating unit 503. The pre-mixing burner flame generating unit 503 may be located adjacent to the first end 502 of the body. In other embodiments, the pre-mixing burner flame generating unit 503 may be located elsewhere on the body of the cigarette lighter 500. For example, the pre-mixing burner flame generating unit 503 may be located between the first end 502 and the second end 504 of the body. The pre-mixing burner flame generating unit 503 may be configured to mix the combustible fuel with air and at least partially contain a flame.

The cigarette lighter 500 includes a valve 505 in fluidic communication with the fuel reservoir 501 and the pre-mixing burner flame generating unit 503. The valve 505 may be configured to facilitate the combustible fuel to enter the pre-mixing burner flame generating unit 503 when the valve 505 is actuated.

The cigarette lighter 500 may include a bracket 507. The bracket 507 may be in mechanical communication with the valve 505 and configured to actuate the valve 505 when a force is applied to the bracket 507 by a user. The cigarette lighter 500 may further include a gas lever 513 in mechanical communication with the valve 505 and the bracket 507. The gas lever 513 may be configured to facilitate actuation of the valve 505 when a force is applied to the bracket 507 by a user. In some embodiments, the gas lever 513 may rotate about a gas lever fulcrum. For example, when the bracket 507 is pushed down, the portion of the gas lever 513 immediately adjacent to the bracket 507 is also pushed down. The gas lever 513 rotates about the gas lever fulcrum such that the portion of the gas lever 513 immediately adjacent to the valve 505 pushes up on the valve 505. When the valve 505 is pushed up, the valve 505 is actuated which releases the combustible fuel into the pre-mixing burner flame generating unit 503.

In some embodiments, the bracket 507 and the gas lever 513 may be mechanically coupled together. For example, the bracket 507 and the gas lever 513 may be pinned, screwed, or glued together. In other embodiments, the bracket 507 and the gas lever 513 may be a single integrated component. Still in other embodiments, the bracket 507 and the gas lever 513 may be separate components in mechanical communication with each other.

The cigarette lighter 500 may include a thumb ledge 519 mechanically coupled to the bracket 507. For example, the bracket 507 and the thumb ledge 519 may be pinned, screwed, or glued together. In other embodiments, the bracket 507 and the thumb ledge 519 may be a single integrated component. The thumb ledge 519 may be configured to allow a user to exert a force on the bracket 507.

The cigarette lighter 500 may include a friction wheel assembly 509. The friction wheel assembly 509 may be in mechanical communication with the bracket 507 and may be configured to rotate about an axis. The cigarette lighter 500 may include a flint 511. The flint 511 may be in mechanical communication with the friction wheel assembly 509 and may be configured to emit sparks when the friction wheel assembly 509 is rotated about the axis by a user.

The cigarette lighter 500 may include a spring 517. The spring 517 may be placed adjacent to the flint 511 such that the flint 511 is located between the friction wheel assembly 509 and the spring 517. The spring 517 may be configured to apply a spring force on the flint 511 to force the flint 511 against the friction wheel assembly 509. This may allow for a more reliable generation of sparks due to the flint 511 being forced against the friction wheel assembly 509. In some embodiments, the spring force may lie along an axis that is perpendicular to the axis of rotation of the friction wheel assembly 509. In some embodiments, the bracket 507 may be configured to actuate along an axis parallel to the axis of the spring force.

In some embodiments, the spring 517 and the flint 511 may be located within the bracket 507. For example, the bracket 507 may have a cavity where the flint 511 and the spring 517 are located. In some embodiments, the friction wheel assembly 509 may be coupled to the bracket 507. In other embodiments, the friction wheel assembly 509 may be coupled to the body of the cigarette lighter 500 via a flexible coupler. For example, the friction wheel assembly 509 may be coupled to the first end 502 of the body and positioned such that the flint 511 and the spring 517 are prevented from leaving the cavity of the bracket 507.

Figure 5B:
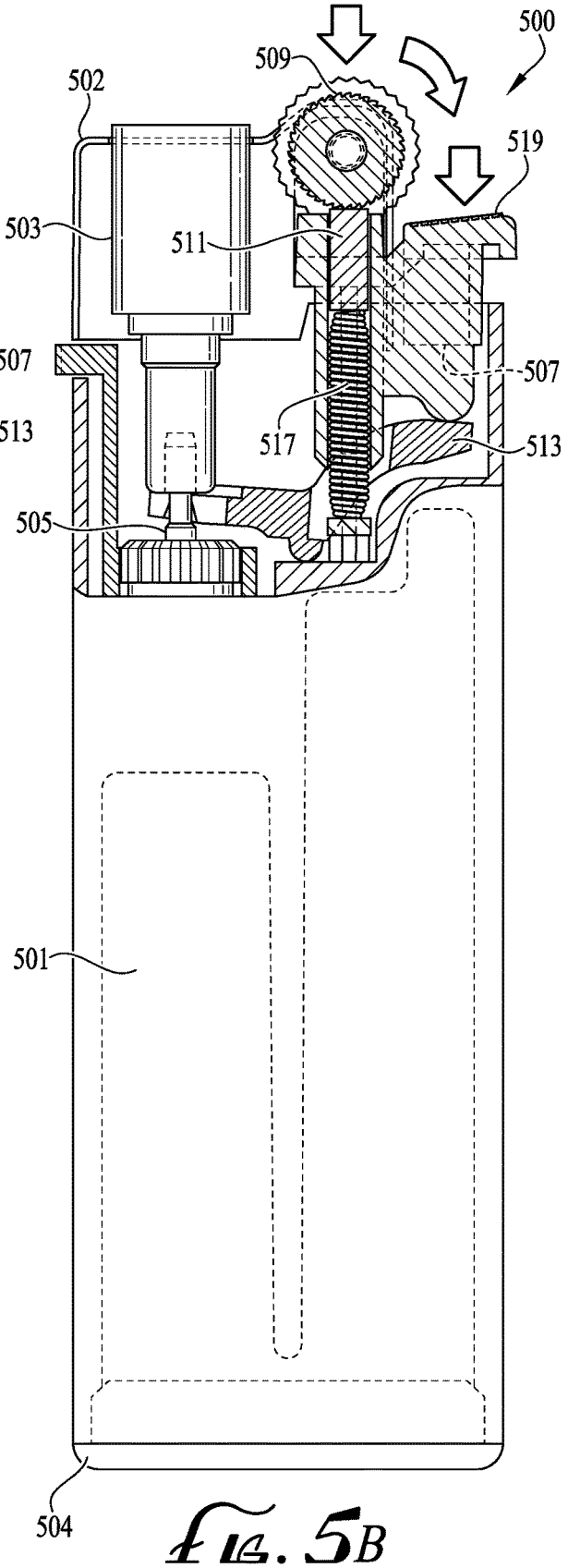
FIG. 5B shows a cross sectional view of the cigarette lighter from FIG. 5A according to an aspect of the invention.

FIG. 5B illustrates a cross sectional view of the cigarette lighter 500 from FIG. 5A according to an embodiment of the invention. More specifically, FIG. 5B illustrates the actuation of the cigarette lighter 500 by a user.

To actuate the cigarette lighter 500, a user may first initiate a gas discharge operation. According to various embodiments, the gas discharge operation is as follows. A user may first apply a downward force on the friction wheel assembly 509. The downward force causes the friction wheel assembly 509 and the bracket 507 to move down under the downward force from the user. As the bracket 507 moves down it causes the gas lever 513 to rotate about the gas lever fulcrum. As the gas lever 513 rotates a portion of the gas lever 513 actuates the valve 505. When the valve 505 is actuated, the combustible fuel is released from the fuel reservoir 501 and enters the pre-mixing burner flame generating unit 503.

Next a user may then initiate an ignition operation. According to various embodiments, the ignition operation is as follows. While the user is applying a downward force on the friction wheel assembly 509, the user may apply a rotational force to the friction wheel assembly 509. When the friction wheel assembly 509 receives the rotational force by the user, the friction wheel assembly 509 rotates against a surface of the flint 511 to cause the flint 511 to emit sparks. When the sparks contact the combustible fuel in the pre-mixing burner flame generating unit 503 a flame is produced. The pre-mixing burner flame generating unit 503 will continue to hold the flame for as long as the combustible fuel is being supplied to it. For example, the pre-mixing burner flame generating unit 503 will continue to hold the flame as long as the user keeps applying a downward force to the friction wheel assembly 509 or the bracket 507.

In some embodiments, the gas discharge operation and the friction operation may be performed simultaneously by a user. For example, a user may simultaneously apply a downward force on the friction wheel assembly 509 while also applying a rotational force to the friction wheel assembly 509. Under this scenario, the user causes sparks to be generated at the same time the combustible fuel is being supplied to the pre-mixing burner flame generating unit 503 which produces the flame.

In other embodiments, a user may simultaneously apply a downward force on the friction wheel assembly 509 while also applying a rotational force to the friction wheel assembly 509 before the user shifts to a downward force to the bracket 507. Under this scenario, the user causes sparks to be generated at the same time the combustible fuel is being supplied to the pre-mixing burner flame generating unit 503. After the flame is generated the user shifts the downward force to bracket 507 to continue supplying the combustible fuel to the pre-mixing burner flame generating unit 503 which ensures an uninterrupted flame.

Figure 6A:
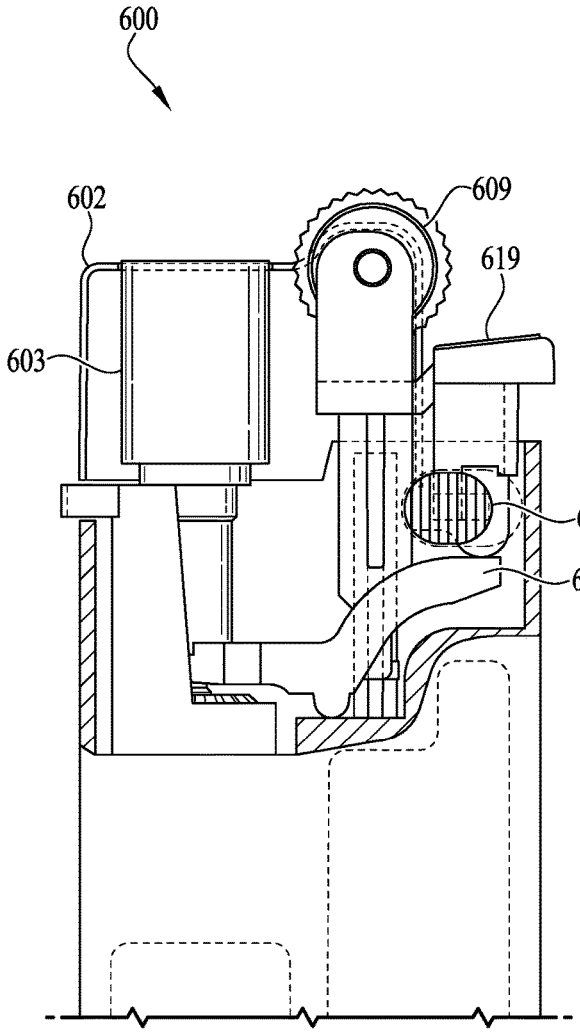
FIG. 6A shows a cross sectional view of a cigarette lighter according to an aspect of the invention.

FIG. 6A illustrates a cross sectional view of a cigarette lighter 600 according to an embodiment of the invention. The cigarette lighter 600 includes many of the same features as cigarette lighters 100, 200, 300, 400, and 500, and have been similarly numbered accordingly.

Cigarette lighter 600 includes a slide lock 627 that may be actuated by a user to prevent accidental discharge of the combustible fuel. As depicted in FIG. 6A, the slide lock 627 is in the actuated "locked" position. In some embodiments, the slide lock 627 may prevent the gas lever 613 from being unintentionally actuated. In other embodiments, the slide lock 627 may prevent the thumb ledge 619 from being depressed.

Figure 6B:
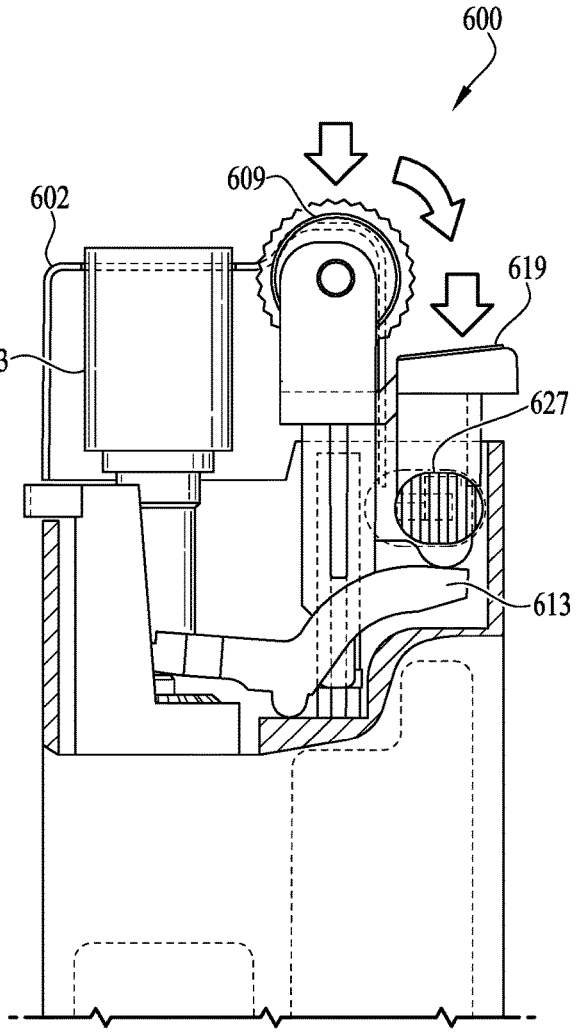
FIG. 6B shows a cross sectional view of the cigarette lighter from FIG. 6A according to an aspect of the invention.

FIG. 6B illustrates a cross sectional view of the cigarette lighter 600 from FIG. 6A according to an embodiment of the invention. As depicted in FIG. 6B, the slide lock 627 is in the "unlocked" position which allows a user to operate the cigarette lighter 600.

Figure 7:
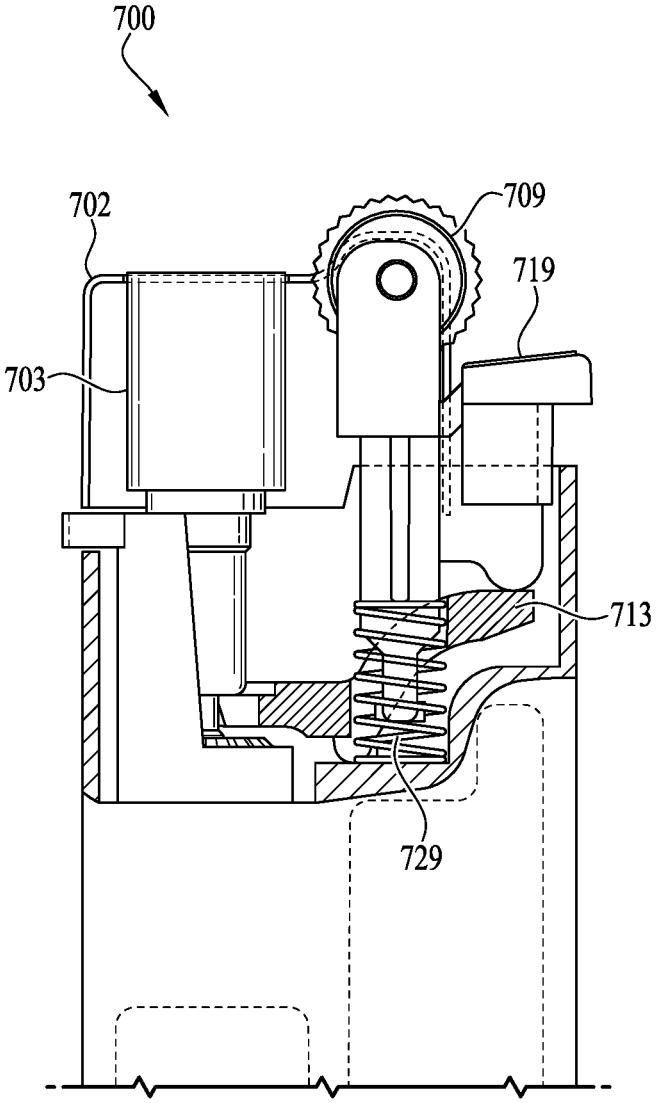
FIG. 7 shows a cross sectional view of a cigarette lighter according to an aspect of the invention.

FIG. 7 illustrates a cross sectional view of a cigarette lighter 700 according to an embodiment of the invention. The cigarette lighter 700 includes many of the same features as cigarette lighters 100, 200, 300, 400, and 500, and have been similarly numbered accordingly.

Cigarette lighter 700 includes a resistance spring 729 to help prevent accidental discharge of the combustible fuel. The resistance spring 729 provides a resisting force against the actuation of the cigarette lighter 700 that a user must overcome in order to operate the cigarette lighter 700.

Figures 8A, 8B, 8C:
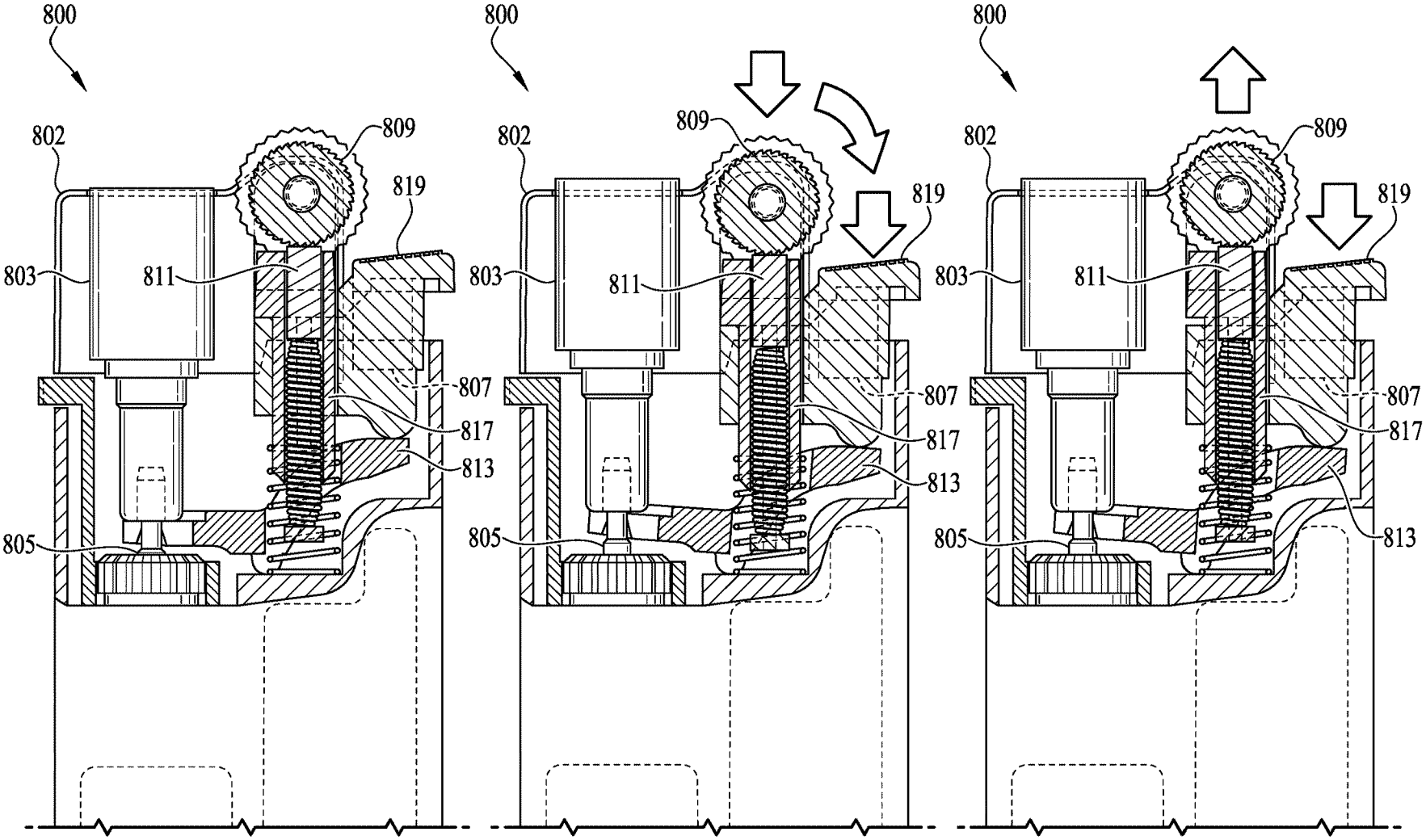
FIG. 8A shows a cross sectional view of a cigarette lighter according to an aspect of the invention.
FIG. 8B shows a cross sectional view of the cigarette lighter from FIG. 8A according to an aspect of the invention.
FIG. 8C shows a cross sectional view of the cigarette lighter from FIGS. 8A and 8B according to an aspect of the invention.

FIGS. 8A-8C illustrate a cross sectional view of a cigarette lighter 800 according to an embodiment of the invention. The cigarette lighter 800 includes many of the same features as cigarette lighters 100, 200, 300, 400, and 500, and have been similarly numbered accordingly.

As depicted in FIGS. 8A-8C, the gas discharge assembly which includes the bracket 807, the gas lever 813, and the thumb ledge 819 are separate from the ignition assembly which includes the friction wheel 809, the flint 811, and the spring 817. For example, a user may be able to actuate the gas discharge assembly and the ignition assembly independently of the other.

FIG. 8A illustrates the resting "initial" state of the cigarette lighter 800. FIG. 8B illustrates the ignition operation (e.g. actuation of the gas discharge assembly and the ignition assembly by a user). FIG. 8C illustrates the continuous state where a flame has been generated and the user is continuously actuating the gas discharge assembly for a continuous flame.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of systems, apparatuses, and methods disclosed herein, which is defined solely by the claims. Accordingly, the systems, apparatuses, and methods are not limited to that precisely as shown and described.

Certain embodiments of systems, apparatuses, and methods are described herein, including the best mode known to the inventors for carrying out the same. Of course, variations of these described embodiment swill become apparent to those of ordinary skill in the art upon reading the foregoing description. The inventor expects skilled artisans to employ such variations as appropriate, and the inventors intend for the systems, apparatuses, and methods to be practiced otherwise than specifically described herein. Accordingly, the systems, apparatuses, and methods include all modifications and equivalents of the subject matter recited in the claims appended hereto as permitted by applicable law. Moreover, any combination of the above-described embodiments in all possible variations thereof is encompassed by the systems, apparatuses, and methods unless otherwise indicated herein or otherwise clearly contradicted by context.

Groupings of alternative embodiments, elements, or steps of the systems, apparatuses, and methods are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses an approximation that may vary, yet is capable of performing the desired operation or process discussed herein.

The terms "a," "an," "the" and similar referents used in the context of describing the systems, apparatuses, and methods (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the systems, apparatuses, and methods and does not pose a limitation on the scope of the systems, apparatuses, and methods otherwise claimed. No language in the present specification should be construed as indicating any non-claimed element essential to the practice of the systems, apparatuses, and methods.

All patents, patent publications, and other publications referenced and identified in the present specification are individually and expressly incorporated herein by reference in their entirety for the purpose of describing and disclosing, for example, the compositions and methodologies described in such publications that might be used in connection with the systems apparatuses, and methods. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

What is claimed is:

1. A cigarette lighter comprising:

a fuel reservoir configured to contain a fuel;

a pre-mixing burner flame generating unit configured to mix the fuel with air;

a valve in fluidic communication with the fuel reservoir and the pre-mixing burner flame generating unit and configured to facilitate the fuel to enter the pre-mixing burner flame generating unit as a gas when the valve is actuated;

a bracket configured to engage a gas lever to actuate the valve to release the gas into the pre-mixing burner flame generating unit;

a friction wheel assembly having a friction wheel wherein the friction wheel is in contact with a flint and the friction wheel assembly is in mechanical communication with the bracket; the friction wheel assembly is capable of downward movement to depress the bracket at the same time that the friction wheel is rotating against the flint; and, whereby release of the gas and generation of a spark occur simultaneously to result in generation of a flame.

2. The cigarette lighter of claim 1, wherein said mechanical communication with the bracket is in the form of an integral connection between the friction wheel assembly and the bracket.

3. The cigarette lighter of claim 2, further comprising a spring, wherein the flint is located between the friction wheel assembly and the spring, the spring having a spring force and being configured to bias the flint against the friction wheel assembly and to bias the friction wheel assembly in an initial position in which the friction wheel assembly is not biasing the bracket downward.

4. The cigarette lighter of claim 3, wherein the spring force biases the spring against the flint along an axis that is perpendicular to the axis of rotation of the friction wheel.

5. The cigarette lighter of claim 4, wherein the bracket is configured to actuate along an axis parallel to the axis of the spring force.

6. The cigarette lighter of claim 5, further comprising a thumb ledge integrally connected to the bracket and configured to allow a user to exert a force on the bracket.

7. A cigarette lighter comprising:

a body extending along an axis and having a first end and a second end opposite the first end;

a fuel reservoir located within the body and configured to contain a fuel;

a pre-mixing burner flame generating unit located adjacent to the first end of the body and configured to mix the fuel with air;

a valve in fluidic communication with the fuel reservoir and the pre-mixing burner flame generating unit and configured to facilitate the fuel to enter the pre-mixing burner flame generating unit as a gas when the valve is actuated;

a bracket configured to engage a gas lever to actuate the valve to release the gas into the pre-mixing burner flame generating unit;

a friction wheel assembly having a friction wheel wherein the friction wheel is in contact with a flint and the friction wheel assembly is in mechanical communication with the bracket; the friction wheel assembly is capable of movement along the axis of the body to depress the bracket at the same time that the friction wheel is rotating against the flint; and, whereby release of the gas and generation of a spark occur simultaneously to result in generation of a flame.

8. The cigarette lighter of claim 7, wherein said mechanical communication with the bracket is in the form of an integral connection between the friction wheel assembly and the bracket.

9. The cigarette lighter of claim 8, further comprising a spring, wherein the flint is located between the friction wheel assembly and the spring, the spring having a spring force and being configured to bias the flint against the friction wheel assembly and to bias the friction wheel assembly in an initial position in which the friction wheel assembly is not biasing the bracket towards gas lever engagement.

10. The cigarette lighter of claim 9, wherein the spring force lies along an axis that is perpendicular to the axis of rotation of the friction wheel.

11. The cigarette lighter of claim 10, wherein the bracket is configured to actuate along an axis parallel to the axis of the spring force.

12. The cigarette lighter of claim 11, further comprising a thumb ledge integrally connected to the bracket and configured to allow a user to exert a force on the bracket.

* * * * *